US005499517A

United States Patent [19]

McCraw

[11] Patent Number: 5,499,517

[45] Date of Patent: Mar. 19, 1996

[54] ROLLING GATE STOPPING AND LOCKING SYSTEM

[76] Inventor: Scottland D. McCraw, 1580 Southgate Ave. #215, Daly City, Calif. 94015-2232

[21] Appl. No.: 339,793

[22] Filed: Nov. 15, 1994

[51] Int. Cl.[6] ..... E05B 65/08

[52] U.S. Cl. ..... 70/95; 70/14; 70/99; 292/339; 256/73; 256/1; 49/449; 160/201; 16/86 R

[58] Field of Search ..... 70/32, 34, 95, 70/99, 14; 292/289, 288, 343, 339, DIG. 46, DIG. 15; 256/73, 1; 49/449; 411/377, 542, 544, 915; 160/201, 206; 16/82, 86 A, 86 R

[56] References Cited

U.S. PATENT DOCUMENTS

| | | | |
|---|---|---|---|
| 1,801,077 | 4/1931 | Gentry | 411/377 |
| 1,803,610 | 5/1931 | Greene | 292/DIG. 15 |
| 2,140,749 | 12/1938 | Kaplan | 411/377 |
| 2,687,548 | 8/1954 | Price | 292/DIG. 15 |
| 3,751,084 | 8/1973 | Lening | 292/114 |
| 3,871,134 | 3/1975 | Lening | 292/114 |
| 3,922,893 | 12/1975 | Berg | 70/95 |
| 3,977,714 | 8/1976 | Trotter | 16/86 R |
| 4,135,747 | 1/1979 | Melilli | 292/175 |
| 4,861,079 | 8/1989 | De Forrest, Sr. | 292/DIG. 46 |
| 5,113,629 | 5/1992 | Carrick | 292/DIG. 46 |
| 5,332,251 | 7/1994 | Farquhar | 70/14 |
| 5,383,254 | 1/1995 | Wigley, Sr. | 292/DIG. 15 |

FOREIGN PATENT DOCUMENTS

| | | | |
|---|---|---|---|
| 2822839 | 11/1979 | Germany | 70/14 |
| 239737 | 9/1925 | United Kingdom | 16/86 |

*Primary Examiner*—Darnell M. Boucher

[57] ABSTRACT

A new and improved rolling gate stopping and locking system comprising a steel pole having a first end, a second end, and an intermediate extent therebetween. The steel pole has an aperture drilled therethrough upwardly of the first end. The steel pole is positionable within an aperture drilled through a stationary portion of a rolling gate. Included in the system is a rubber head having a flat upper surface and a contoured lower surface. The rubber head is secured to the second end of the steel pole. The second end of the steel pole extends upwardly through the contoured lower surface. The contoured lower surface corresponds with the stationary portion of the rolling gate to prevent the rolling gate from advancing thereby opening the rolling gate. A padlock is securable to the aperture drilled through the steel pole. The padlock serves to lock the steel pole to the rolling gate.

4 Claims, 4 Drawing Sheets

ROLLING GATE STOPPING AND LOCKING SYSTEM

BACKGROUND OF THE INVENTION

1. Field of the Invention

The present invention relates to a rolling gate stopping and locking system and more particularly pertains to locking a rolling gate in place without being able to be cut by bolt cutters with a rolling gate stopping and locking system.

2. Description of the Prior Art

The use of gate locks is known in the prior art. More specifically, gate locks heretofore devised and utilized for the purpose of locking gates are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,570,467 to Greco discloses a locking system for rolling type gate.

U. S. Pat. No. 4,114,408 to Gee discloses a gate lock and latch.

U.S. Pat. No. 3,976,315 discloses a gate lock for locking a gate to a fence.

U.S. Pat. No. 4,086,794 to Richards discloses a gate lock mechanism housed in a steel case and directly weldable to iron doors.

U.S. Pat. No. 3,956,996 to Fischer discloses a pivoted slide gate lock.

While these devices fulfill their respective, particular objective and requirements, the aforementioned patents do not describe a rolling gate stopping and locking system for locking a rolling gate in place without being able to be cut by bolt cutters.

In this respect, the rolling gate stopping and locking system according to the present invention substantially departs from the conventional concepts and designs of the prior art, and in doing so provides an apparatus primarily developed for the purpose of locking a rolling gate in place without being able to be cut by bolt cutters.

Therefore, it can be appreciated that there exists a continuing need for new and improved rolling gate stopping and locking system which can be used for locking a rolling gate in place without being able to be cut by bolt cutters. In this regard, the present invention substantially fulfills this need.

SUMMARY OF THE INVENTION

In the view of the foregoing disadvantages inherent in the known types of gate locks now present in the prior art, the present invention provides an improved rolling gate stopping and locking system. As such, the general purpose of the present invention, which will be described subsequently in greater detail, is to provide a new and improved rolling gate stopping and locking system and method which has all the advantages of the prior art and none of the disadvantages.

To attain this, the present invention essentially comprises a rolling gate having an upper portion and a lower portion. The upper portion has a top portion and a bottom portion. The top portion has a fence secured thereto that extends upwardly therefrom. The bottom portion has wheels secured thereto. The wheels align with a rounded surface of the lower portion for rolling thereon. The lower portion has an aperture drilled therethrough. The aperture is positioned adjacent to an end portion of the upper portion. The device contains a steel pole having a first end, a second end, and an intermediate extent therebetween. The steel pole has an aperture drilled therethrough upwardly of the first end. The steel pole is positionable within the aperture formed through the lower portion of the rolling gate. The device contains a rubber head having a flat upper surface and a contoured lower surface. The rubber head is secured to the second end of the steel pole. The second end of the steel pole extends upwardly through the contoured lower surface. The contoured lower surface corresponds with the rounded surface of the lower portion of the rolling gate to prevent the wheels of the bottom portion of the rolling gate from advancing thereby opening the rolling gate. The device contains a padlock that is securable to the aperture drilled through the steel pole. The padlock serves to lock the steel pole to the rolling gate.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved rolling gate stopping and locking system which has all the advantages of the prior art gate locks and none of the disadvantages.

It is another object of the present invention to provide a new and improved rolling gate stopping and locking system which may be easily and efficiently manufactured and marketed.

It is a further object of the present invention to provide a new and improved rolling gate stopping and locking system which is of durable and reliable construction.

An even further object of the present invention is to provide a new and improved rolling gate stopping and locking system which is susceptible of a low cost of manufacture with regard to both materials and labor, and which accordingly is then susceptible of low prices of sale to the consuming public, thereby making such a rolling gate stopping and locking system economically available to the buying public.

Still yet another object of the present invention is to provide a new and improved rolling gate stopping and locking system which provides in the apparatuses and methods of the prior art some of the advantages thereof, while simultaneously overcoming some of the disadvantages normally associated therewith.

Even still another object of the present invention is to provide a new and improved rolling gate stopping and locking system for locking a rolling gate in place without being able to be cut by bolt cutters.

Lastly, it is an object of the present invention to provide a new and improved rolling gate stopping and locking system comprising a steel pole having a first end, a second end, and an intermediate extent therebetween. The steel pole has an aperture drilled therethrough upwardly of the first end. The steel pole is positionable within an aperture drilled through a stationary portion of a rolling gate. Included in the system is a rubber head having a flat upper surface and a contoured lower surface. The rubber head is secured to the second end of the steel pole. The second end of the steel pole extends upwardly through the contoured lower surface. The contoured lower surface corresponds with the stationary portion of the rolling gate to prevent the rolling gate from advancing thereby opening the rolling gate. A padlock is securable to the aperture drilled through the steel pole. The padlock serves to lock the steel pole to the rolling gate.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
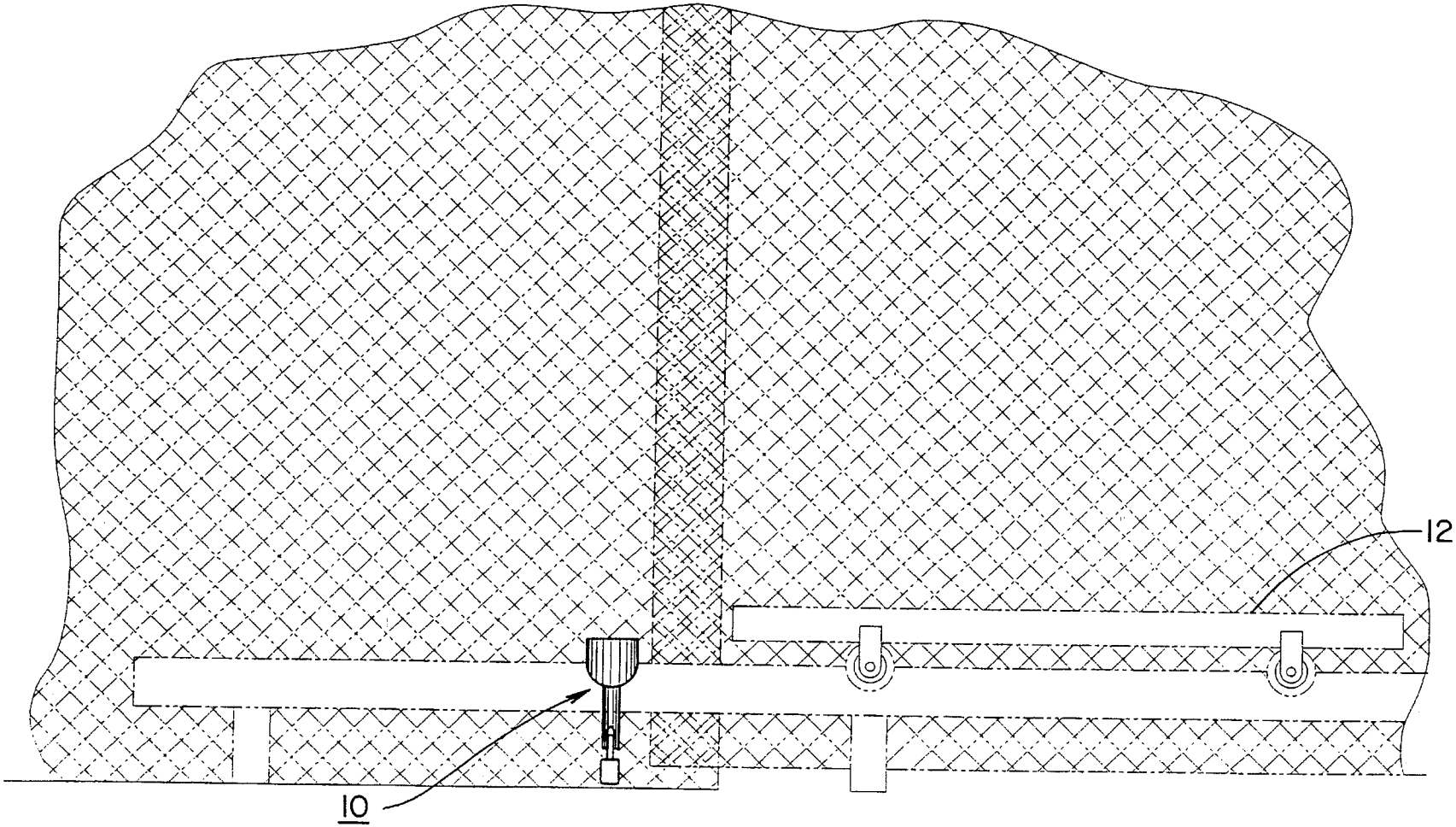
FIG. 1 is a perspective view of the preferred embodiment of the rolling gate stopping and locking system constructed in accordance with the principles of the present invention.
Figure 2:
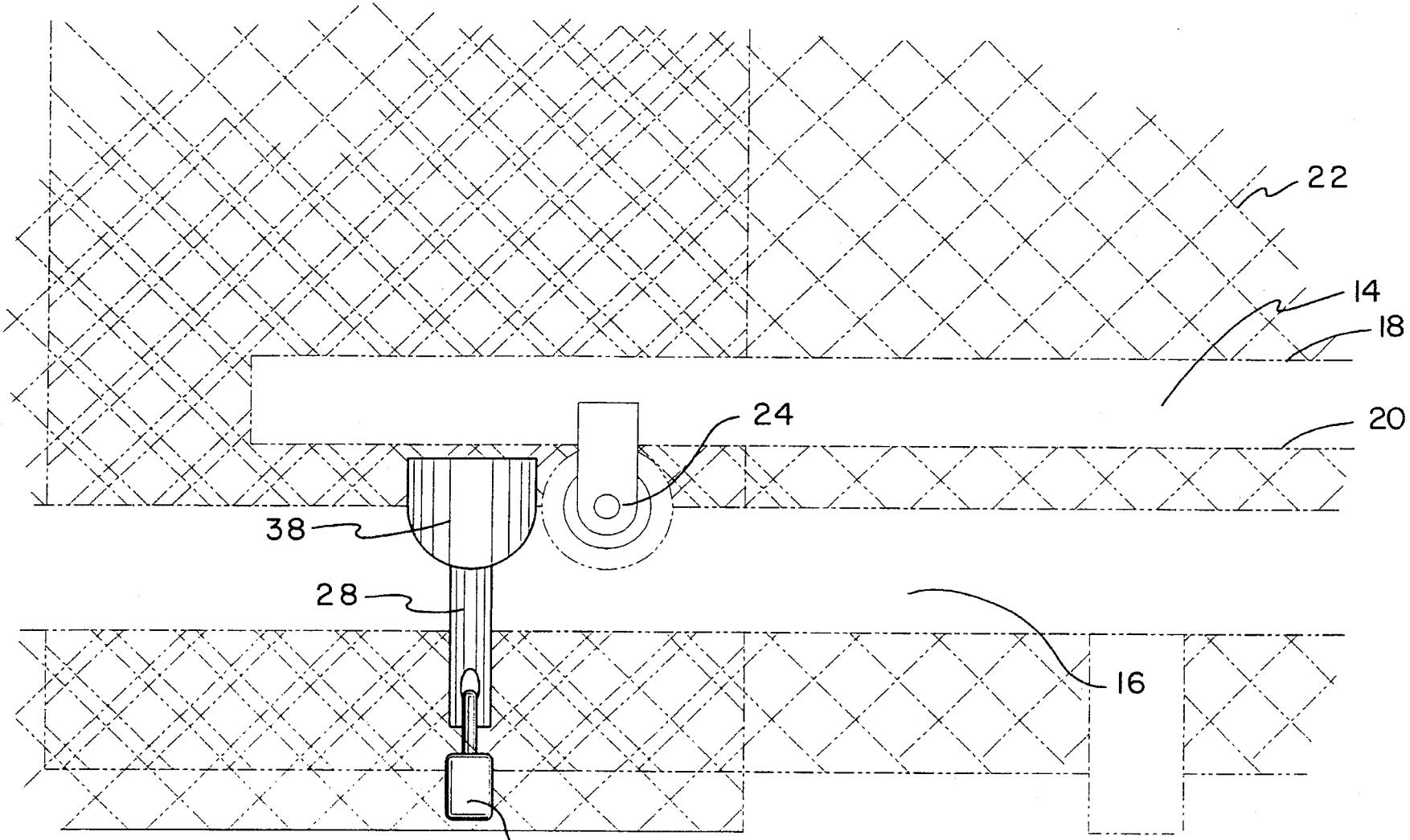
FIG. 2 is an enlarged front view of the present invention.
Figures 3, 4:
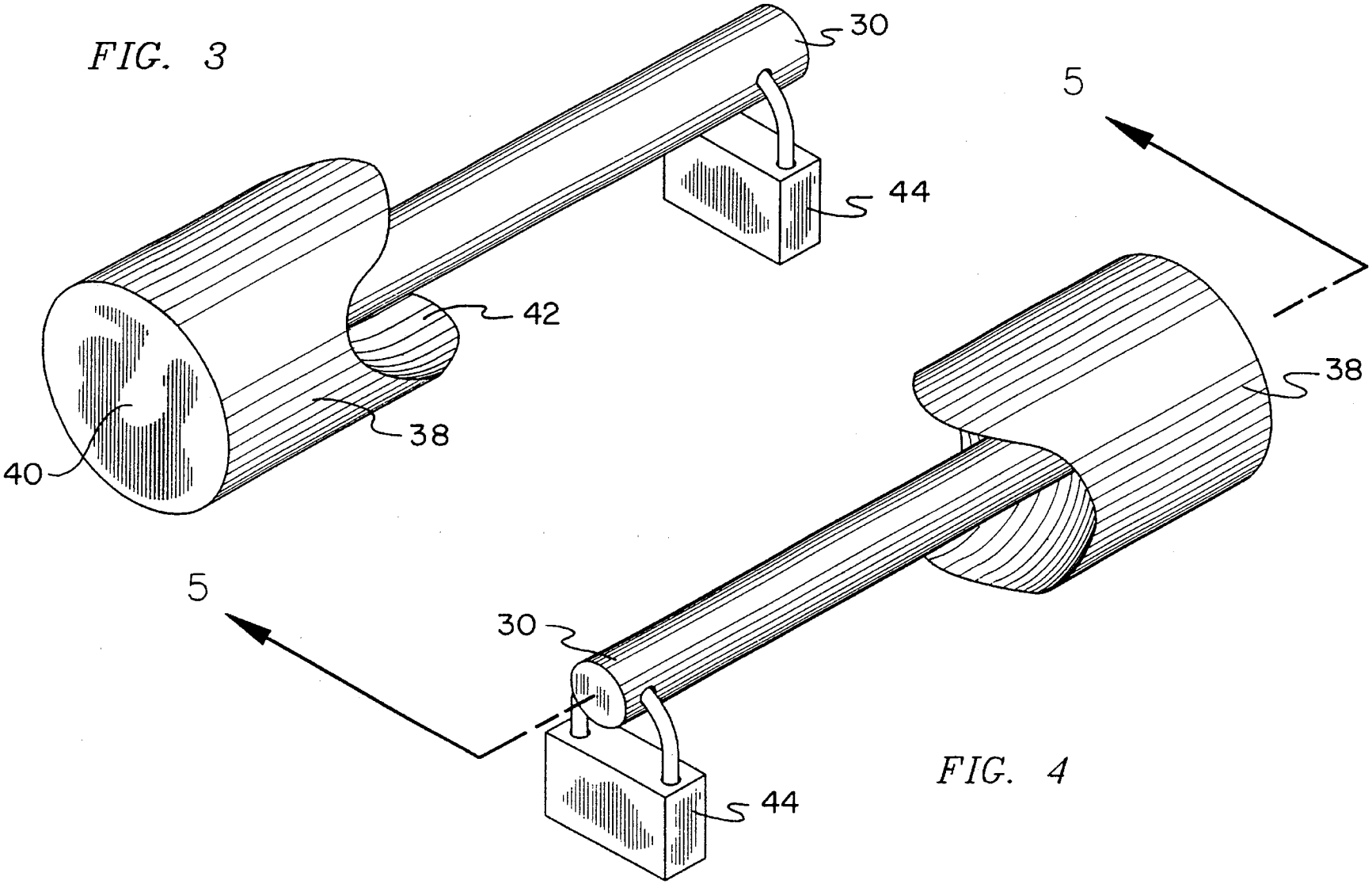
FIG. 3 is a rear perspective view of the present invention.
FIG. 4 is a front perspective view of the present invention.
Figure 5:
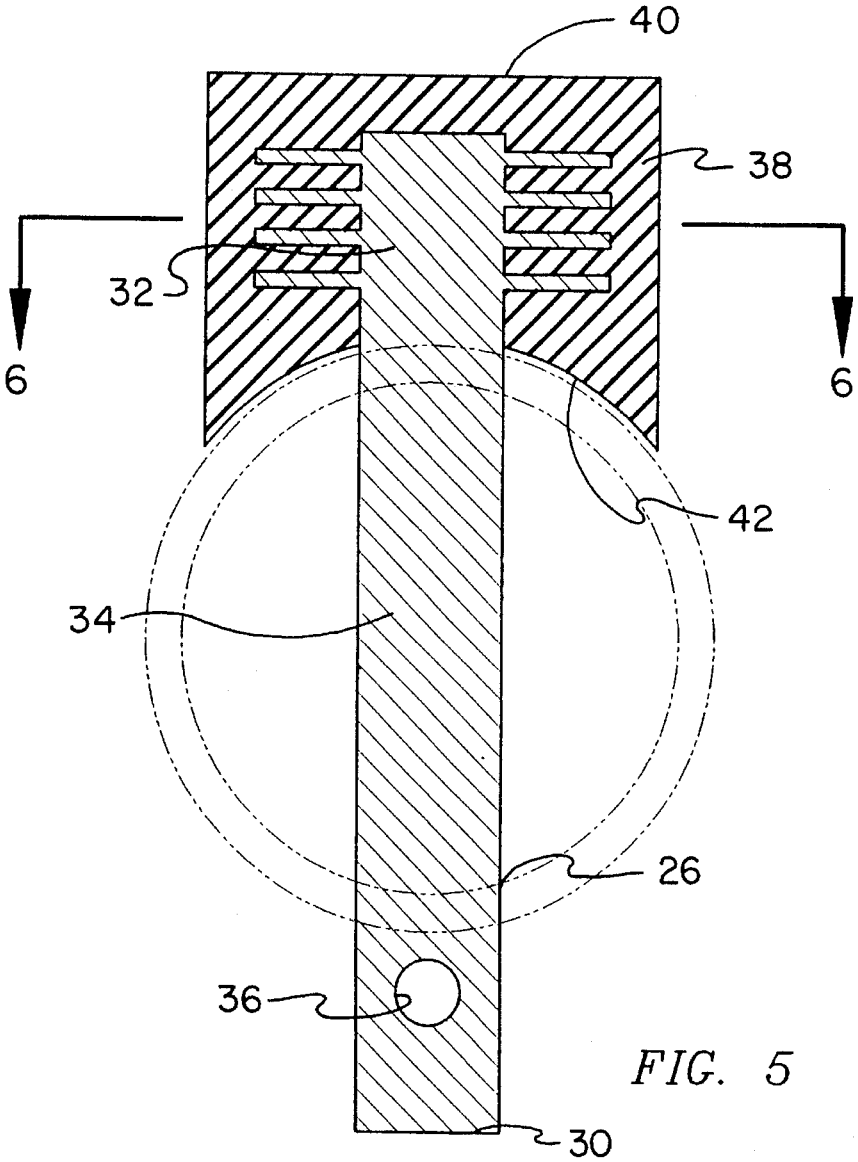
FIG. 5 is a cross-sectional view as seen along line 5—5 of FIG. 4.
Figure 6:
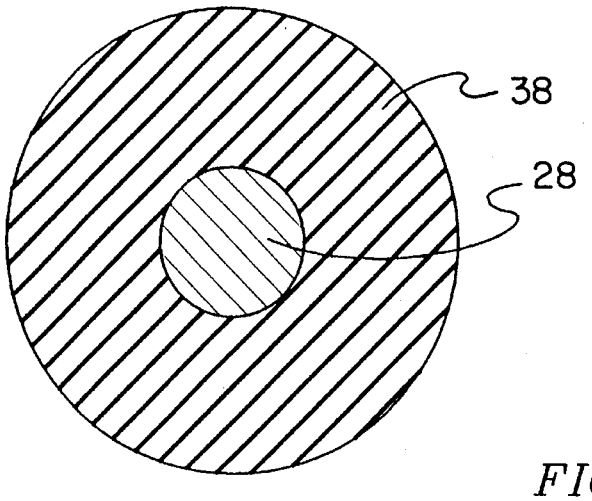
FIG. 6 is a cross-sectional view as seen along line 6—6 of FIG. 5.

With reference now to the drawings, and in particular, to FIG. 1 thereof, the preferred embodiment of the new and improved rolling gate stopping and locking system embodying the principles and concepts of the present invention and generally designated by the reference number 10 will be described.

Specifically, it will be noted in the various Figures that the device relates to a new and improved rolling gate stopping and locking system for locking a rolling gate in place without being able to be cut by bolt cutters. In its broadest context, the device consists of a rolling gate, a steel pole, a rubber head, and a padlock.

The device 10 contains a rolling gate 12 having an upper portion 14 and a lower portion 16. The upper portion 14 has a top portion 18 and a bottom portion 20. The top portion 18 has a fence 22 secured thereto that extends upwardly therefrom. The bottom portion 20 has wheels 24 secured thereto. The wheels 24 align with a rounded surface of the lower portion 16 for rolling thereon. The lower portion 16 has an aperture 26 drilled therethrough. The aperture 26 is positioned adjacent to an end portion of the upper portion 14. The lower portion 16 is preferably three inches thick, but could be constructed in a variety of thicknesses. The rolling gate 12 is operable by sliding the upper portion 14 in relation to the lower portion 16 for the user to gain access to a parking area or an estate.

The device 10 contains a steel pole 28 having a first end 30, a second end 32, and an intermediate extent 34 therebetween. The steel pole 28 has an aperture 36 drilled therethrough upwardly of the first end 30. The steel pole 28 is positionable within the aperture 26 formed through the lower portion 16 of the rolling gate 12. The steel pole 28 prevents the rolling gate 12 from opening by impeding the wheels 24 from rolling. The steel pole 28 is preferably four inches tall and the aperture 36 is ½" thick. The height of the steel pole 28 can vary in relation to the thickness of the lower portion 16 of the rolling gate 12.

The device 10 contains a rubber head 38 having a flat upper surface 40 and a contoured lower surface 42. The rubber head 38 is secured to the second end 32 of the steel pole 28. The second end 32 of the steel pole 28 extends upwardly through the contoured lower surface 42. The contoured lower surface 42 corresponds with the rounded surface of the lower portion 16 of the rolling gate 12 to prevent the wheels 24 of the bottom portion 20 of the rolling gate 12 from advancing thereby opening the rolling gate 12. The rubber head 38 is preferably four inches in height.

The device 10 contains a padlock 44 that is securable to the aperture 36 drilled through the steel pole 28. The padlock 44 serves to lock the steel pole 28 to the rolling gate 12. Any type of lock can be incorporated into the device 10, but the recommended type of lock is one that is heavy duty.

The present invention is a novel lock for rolling gates 12. Once locked in place, the gate cannot be opened by unauthorized personnel.

The mechanism is very simple in construction and design, comprising a steel pole 28 and a rubber head 38, or stopper. While different sizes could be produced for the various gate types, the version described here is for a gate having a 3" pipe. The pole 28 is 4" long with a ½" hole through its bottom, with the hole just above the lower end of the pole 28. The hole is drilled perpendicularly through the pole 28. Affixed to the top of the pole 28 is the rubber gate stopper 38. It is 4" tall, with rounded corners, and a curved bottom that matches the contour of the gate pipe.

In use, a vertical hole is first drilled through the pipe in the stationary part of the rolling gate 12, adjacent to one of the wheels 24. With the gate closed, the pole 28 is slid through the hole in the gate so that the bottom of the pole 28 protrudes from the pipe underside. A strong padlock 44 is then placed through the hole in the pole 28 to lock the device 10 to the pipe. With the unit thus secured, the rubber head rests firmly on the top of the pipe, preventing the gate from being rolled any distance.

The present invention is designed so that there is no room for bolt cutters. It should be used with a strong padlock 44. It's a big improvement over the conventional method of using a chain and lock. The present invention is ideal for any home or business having a rolling gate 12.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A new and improved rolling gate stopping and locking system for locking a rolling gate in place without being able to be cut by bolt cutters comprising, in combination:

a rolling gate having an upper portion and a lower portion, the upper portion having a top portion and a bottom portion, the top portion having a fence secured thereto extending upwardly therefrom, the bottom portion having wheels secured thereto, the wheels aligning with a rounded surface of the lower portion for rolling thereon, the lower portion having an aperture drilled therethrough, the aperture positioned adjacent to an end portion of the upper portion;

a steel pole having a first end, a second end, and an intermediate extent therebetween, the steel pole having an aperture drilled therethrough upwardly of the first end, the steel pole positionable within the aperture formed through the lower portion of the rolling gate;

a rubber head having a flat upper surface and a contoured lower surface, the rubber head secured to the second end of the steel pole, the second end of the steel pole extending upwardly through the contoured lower surface, the contoured lower surface corresponding with the rounded surface of the lower portion of the rolling gate to prevent the wheels of the bottom portion of the rolling gate from advancing thereby opening the rolling gate;

a padlock securable to the aperture drilled through the steel pole, the padlock serving to lock the steel pole to the rolling gate.

2. A new and improved rolling gate stopping and locking system for locking a rolling gate in place without being able to be cut by bolt cutters comprising, in combination:

a rolling gate;

a steel pole having a first end, a second end, and an intermediate extent therebetween, the steel pole having an aperture drilled therethrough upwardly of the first end, the steel pole positionable within an aperture drilled through a stationary portion of a rolling gate;

a rubber head having a flat upper surface and a contoured lower surface, the rubber head secured to the second end of the steel pole, the second end of the steel pole extending upwardly through the contoured lower surface, the contoured lower surface corresponding with the stationary portion of the rolling gate to prevent the rolling gate from advancing thereby opening the rolling gate;

a padlock securable to the aperture drilled through the steel pole, the padlock serving to lock the steel pole to the rolling gate.

3. The system as described in claim 2 wherein the rolling gate has an upper portion and a lower portion, the upper portion having a top portion and a bottom portion, the top portion having a fence secured thereto extending upwardly therefrom, the bottom portion having wheels secured thereto, the wheels aligning with a rounded surface of the lower portion for rolling thereon, the lower portion having an aperture drilled therethrough, the aperture positioned adjacent to an end portion of the upper portion.

4. A method of use for stopping and locking an upper moving portion of a rolling gate to a lower stationary portion of the rolling gate comprising the steps of:

positioning the steel pole in an aperture of the lower portion of the rolling gate wherein the steel pole has a contoured rubber head and a second end having a hole adapted to accept a padlock;

aligning the contoured head of the steel pole in the lower portion of the rolling gate such that it prevents advancement of a wheel attached to the upper portion of the rolling gate;

placing a shackle of the padlock through the hole of the second end of the steel pole to stop and lock the upper portion of the rolling gate in place with respect to the lower portion.

* * * * *